US006033196A

United States Patent [19]

Schuller et al.

[11] Patent Number: 6,033,196

[45] Date of Patent: Mar. 7, 2000

[54] ROTARY PUMP

[75] Inventors: Ronald A. Schuller, Tulsa; Paul J. Lutes, Edmond; Joseph P. Ashurst, Oklahoma City, all of Okla.

[73] Assignee: Corken, Inc., Oklahoma City, Okla.

[21] Appl. No.: 08/974,342

[22] Filed: Nov. 19, 1997

[51] Int. Cl.[7] ..... F01C 21/04

[52] U.S. Cl. ..... 418/102; 418/133

[58] Field of Search ..... 418/102, 133, 418/104, 270

[56] References Cited

U.S. PATENT DOCUMENTS

| | | | |
|---|---|---|---|
| 4,484,868 | 11/1984 | Shibuya | 418/102 X |
| 5,083,909 | 1/1992 | Kunsemiller et al. | 418/102 |
| 5,197,869 | 3/1993 | Hansen et al. | 418/102 X |
| 5,201,647 | 4/1993 | Niemiec et al. | 418/102 |
| 5,431,552 | 7/1995 | Schuller . | |

*Primary Examiner*—Hoang Nguyen
*Attorney, Agent, or Firm*—Hill & Simpson

[57] ABSTRACT

A sliding vane pump is provided with side plates disposed on opposing sides of the rotor with through holes and grooves in the side plates that cooperate with passageways disposed in the seal head and access head for providing fluid communication to the rotor bearings. As a result, the fluid being pumped is used to lubricate and cool the rotor bearings. Annular grooves disposed in the side plates provide further cooling and lubrication between the side plates and the rotor as well as between the side plates and the seal head and access head. The flow through the pump may be easily reversed by rotating the side plates 180°, switching flow through the passageways in the seal head and access head by plugging one passageway and opening another passageway as well as rotating the vanes 180°. The reversal of the flow may be accomplished without disconnecting the companion piping, the prime mover or the electrical wiring. The side plates disposed on either side of the rotor are also interchangeable and present different wear surfaces to the rotor, depending upon the side of the rotor on which they are placed. Accordingly, the interchangeability of the side plates enables the side plates to be used on both sides of the rotor to extend the working life of the side plates. Galling between the cam and the case is avoided through the use of a tapered cam liner which limits the surface contact between the case and the cam liner.

26 Claims, 5 Drawing Sheets

ROTARY PUMP

FIELD OF THE INVENTION

The present invention relates to rotary pumps, and more specifically, to rotary vane pumps or sliding vane pumps. Still more specifically, the present invention relates to an improved structure that enables the rotor bearings to be lubricated by the fluid being pumped and a structure which makes it easier to reverse the flow of the pump without disconnecting the companion piping, removing the prime mover or disconnecting the wiring conduit connecting the pump to a power supply. Further, the present invention relates to an improved cam liner configuration which makes it easier to remove the cam liner from the casing during the lifetime of the pump.

BACKGROUND OF THE INVENTION

Sliding vane pumps are disclosed in U.S. Pat. Nos. 4,746,280, 4,830,593 and 5,431,552. In a sliding vane pump, the pump casing can include a stationary liner having an inner surface eccentric with respect to an axis of the rotor held within the casing. A plurality of radial slots are arranged in the rotor and each slot holds a vane that is slidably extendable and retractable within the slot. Inlet and outlet openings are arranged around the periphery of the liner in select regions. The fluid enters the inlet openings and is trapped between the rotor and the liner between adjacent moving vanes which are extended outward from their respective slots as the rotor rotates. The fluid is then moved around the interior of the liner with the rotating rotor until the fluid is passed through the outlet openings.

The vanes, sometimes referred to as "blades", must be strategically biased radially outward either by springs or, in some cases, hydraulic pressure of the fluid being pumped. U.S. Pat. No. 5,431,552, which is owned by the assignee of this application, discloses a liner or cam design which enables the vanes to remain more positively actuated during the pumping operation, thereby increasing the pump efficiency while reducing system noise and vibration. The disclosure of U.S. Pat. No. 5,431,552 is incorporated herein by reference.

One problem associated with currently available vane pump designs is the large amounts of maintenance required during the lifetime of such pumps. Specifically, in order to service the rotor bearings, the pump must be substantially disassembled, including the inlet and outlet piping. Often, the prime mover must be removed and the wiring connecting the pump to a power supply must be disconnected. The removal of the companion piping, the prime mover as well as the substantial disassembly of the pump simply to change the rotor bearings is inefficient and time consuming.

Further, in currently available vane pumps, it is difficult to reverse the flow of such pumps. Again, substantial disassembly of a pump is required which often requires the companion piping, prime mover and electrical connections to be disconnected.

Accordingly, there is a need for an improved vane pump design which is both efficient, like the pump disclosed in U.S. Pat. No. 5,431,552, but also which is easier to maintain in terms of the service of the rotor bearing and which is easier to reverse the flow thereof.

SUMMARY OF THE INVENTION

The present invention satisfies the aforenoted needs by providing a rotary vane pump that includes a housing that comprises a case with one open end connected to a mounting bracket and a second open end connected to an access head. A rotor shaft which is connected to a rotor extends through the mounting bracket, seal head, case and into the access head. The rotor is disposed within the case. Two side plates are disposed on either side of the rotor with a first side plate being disposed between the rotor and the seal head and a second side plate disposed between the rotor and the access head. Both side plates include a central aperture for accommodating the rotor shaft.

The rotor shaft is supported by a first bearing disposed between the seal head and the rotor shaft and adjacent to the first side plate. The rotor shaft is also supported by a second bearing disposed between the access head and the rotor shaft and adjacent to the second side plate.

The first side plate includes first and second through holes disposed on opposing sides of the central aperture that provide fluid communication through the first side plate. The first through hole is connected to a first groove that extends radially inward from the first through hole towards the central aperture and therefore towards the first bearing. The first groove provides fluid communication between the first bearing and the first through hole of the first side plate. The first through hole also provides communication between the first groove and the pump chamber.

The seal head includes a first seal head passageway that extends from an end of the seal head that is in abutting engagement with the first side plate to the rotor shaft. When the pump is pumping in one direction, the second through hole of the first side plate is in alignment with this first passageway through the seal head so that fluid can be communicated from the pump chamber, through the second through hole of the first side plate, through the first seal head passageway to the rotor shaft and therefore to the first rotor shaft bearing.

As a result, during operation of the pump, fluid is transmitted through the second through hole of the first side plate, through the first seal head passageway to the first bearing of the rotor shaft thereby lubricating the first bearing of the rotor shaft. Fluid is then transmitted up the first groove in the first side plate through the first through hole in the first side plate into the pump chamber where the fluid is recirculated.

The second side plate also includes at least one through hole (i.e. a "third" through hole) and at least one groove that extends from the central aperture of the second side plate radially outward. The access head also includes a first access head passageway extending from an inner end of the access head that is in abutting engagement with the second side plate and radially inward to the rotor shaft thereby providing fluid communication to the second bearing. Fluid is then communicated from the second bearing radially outward by the groove in the second side plate. As a result, fluid enters the through hole in the second side plate, proceeds radially inward through the first passageway in the access head to the second bearing and thereafter communicated radially outward through the groove in the second side plate to the pump chamber where the fluid is recirculated by the rotating rotor.

To enhance communication through the first and second bearings, linear or helical slots may be provided in the bearings. Or, the bearings may be configured to provide sufficient communication without the need for any such slots or clearances.

In an embodiment, the seal head further comprises a second seal head passageway disposed on an opposing side of the rotor shaft from the first seal head passageway. The second seal head passageway is plugged when the second through hole of the first side plate is in communication with the first seal head passageway. To reverse the pump, the plug is removed from the second seal head passageway and a plug is inserted into the first seal head passageway and the first side plate is rotated or indexed so that the second through hole of the first side plate is in alignment with the second seal head passageway.

In an embodiment, the access head further comprises a second access head passageway disposed on an opposing side of the rotor shaft from the first access head passageway. The second access head passageway is plugged when the through hole of the second side plate is in alignment or in communication with the first access head passageway. To reverse the pump, in combination with the rotation or indexing of the first side plate as discussed above, the plug is removed from the second access head passageway and a plug is inserted into the first access head passageway and the second side plate is rotated so that the through hole of the second side plate is in communication with the second access head passageway.

In an embodiment, the first and second side plates are interchangeable, each including two through holes with one groove extending radially inward from one through hole towards the central aperture.

In an embodiment, the first and second side plates include an annular groove extending around the central aperture of each side plate. Each annular groove is connected by way of a radial groove to a through hole. The combination of the annular and radial groove provides fluid to either the side plate/rotor interface or side plate/access head interface thereby providing lubrication and cooling benefits.

In an embodiment, the pump direction may be reversed quickly and efficiently and without removal or detachment of the companion piping, disconnection of the prime mover, or disconnection of the electrical wiring. Specifically, to reverse the flow of the pump, the access head is removed along with the second side plate, rotor and rotor shaft, and the first side plate. The plug disposed in the second seal head passageway is removed and a plug is placed into the first seal head passageway. The first side plate is replaced, but indexed 180° so that the second through hole is in alignment with the second seal head passageway. After rotating the vanes 180° within their slots disposed in the rotor, the rotor and rotor shaft are then replaced. The second side plate is also replaced but not before indexing or rotating the second side plate approximately 180°. Before replacing the access head, the plug is removed from the first access head passageway and placed into the second access head passageway. Then, the access head is replaced and, because the second side plate has been indexed, the through hole of the second side plate will be in alignment with the second access head passageway which has been unplugged.

In the aforementioned reversed configuration, at the seal head side, fluid will enter the second through hole in the first side plate, proceed down the second seal head passageway to the rotor shaft and first bearing, up the first groove in the first side plate and out through the first through hole to the inlet area of the case. Simultaneously, fluid will proceed through the through hole in the second side plate, down the second seal head passageway to the second rotor bearing before being transmitted up the groove in the second side plate to the inlet area of the case. The steps required to reverse the flow of the pump are fast and easy and the companion piping need not be disconnected.

It is therefore an advantage of the present invention to provide an improved vane pump design whereby the side plates disposed on either side of the rotor are interchangeable.

Another advantage of the present invention is to provide an improved vane pump design whereby the side plates include annular grooves surrounding the central aperture of the side plate and connected by way of a radial groove to a through hole in the side plate for providing liquid to the side plate/rotor interface.

Another advantage of the present invention is to provide an improved vane pump design whereby the side plates include annular grooves surrounding the central aperture of the side plate and connected by way of a radial groove to a through hole in the side plate for providing liquid to the side plate/access head interface.

Another advantage of the present invention is to use the liquid being pumped as a lubricant and coolant between the rotor and side plates disposed on either side of the rotor.

Yet another advantage of the present invention is that it provides an improved vane pump design whereby the flow may be reversed quickly and efficiently and without disconnecting the companion piping.

Another advantage of the present invention is that it provides an improved vane pump design whereby the rotor bearings and other sealing elements may be accessed quickly and easily without disconnecting the companion piping.

Another advantage of the present invention is that it provides an improved vane pump design whereby the rotor bearings and other sealing elements may be accessed quickly and easily without disconnecting the prime mover.

Still another advantage of the present invention is that it provides an improved vane pump design whereby the rotor bearings and other sealing elements may be accessed quickly and easily without disconnecting the wiring connecting the pump to a power supply.

Other objects and advantages of the present invention will become apparent upon reading the following detailed description and appended claims, and upon reference to the accompanying drawings.

BRIEF DESCRIPTION OF THE DRAWINGS

For a more complete understanding of the invention, reference should now be made to the embodiments illustrated in greater detail in the accompanying drawings and described below by way of an example of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1A:
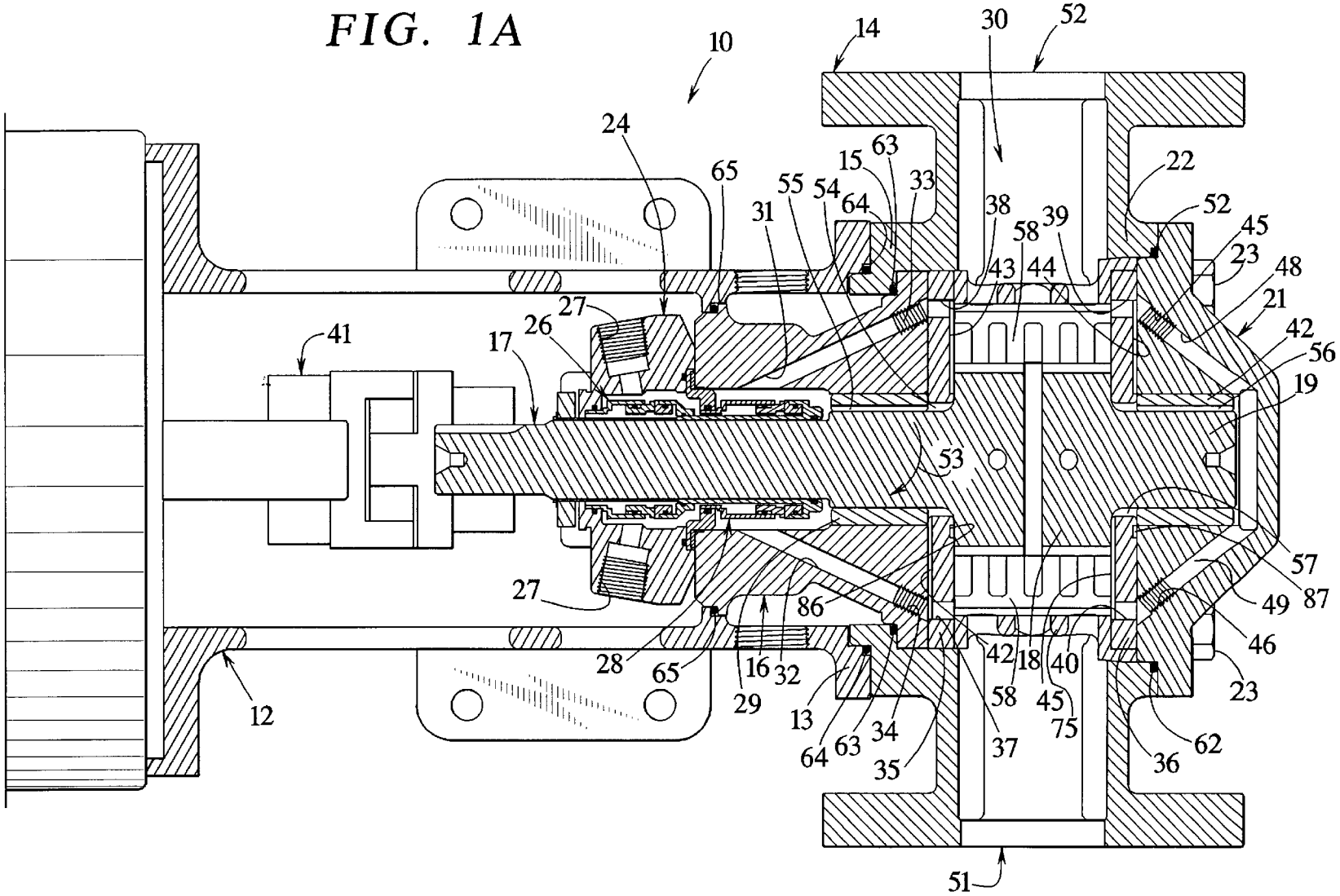
FIG. 1A is a sectional view of a vane pump made in accordance with the present invention and taken substantially along line 1—1 of FIG. 3.

FIG. 1A shows a vane pump 10 that includes a mounting bracket 12 with an open end 13 that is connected to a case 14. The case 14 similarly includes an open end 15 that is matably received within the open end 13 of the mounting bracket 12. Disposed within the mounting bracket 12 is a seal head 16. Extending through the mounting bracket 12, seal head 16 and case 14 is a rotor shaft 17 that includes a rotor section 18 disposed within the pump chamber 30 of the case 14. The rotor shaft 17 also includes a distal end 19 that is received within an access head 21. The access head 21 is mounted onto the open end 22 of the case 14 by way of the bolts shown at 23.

Figure 2:
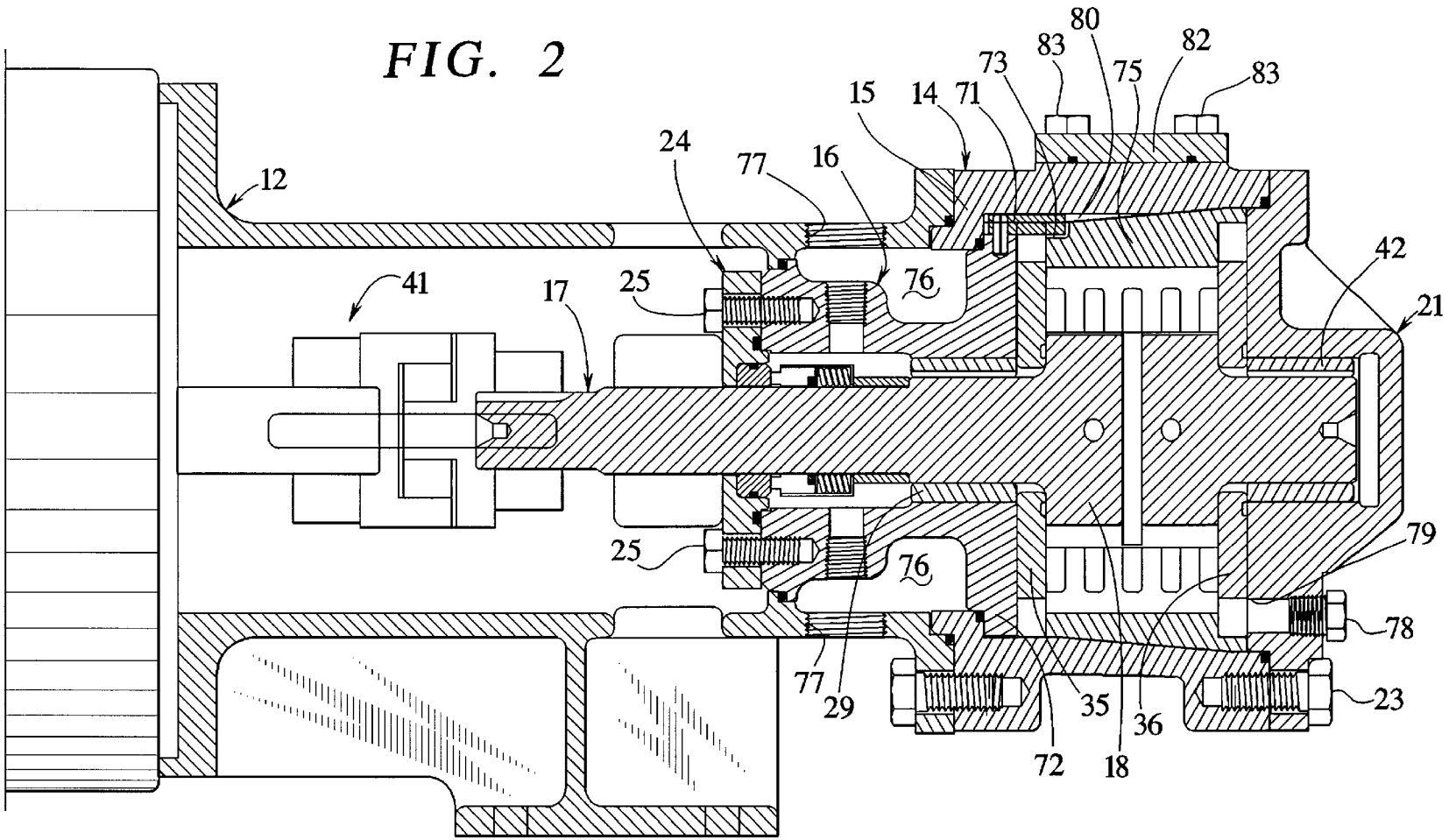
FIG. 2 is another sectional view of the vane pump shown in FIG. 1A and taken substantially along line 2—2 of FIG. 3.

A gland housing 24 is connected to the seal head 16 by the bolts 25 shown in FIG. 2. The gland housing 24 accommodates a seal assembly 26. Lubrication may be provided through either of the ports shown at 27. The seal head 16 accommodates an additional seal assembly 28 and a first rotor bearing 29. For reasons set forth below, the seal head 16 also preferably includes two passageways, including a first seal head passageway 31 and a second seal head passageway 32. The threads shown at 33, 34 accommodate a plug (not shown) which will be discussed in detail below.

Figure 4:
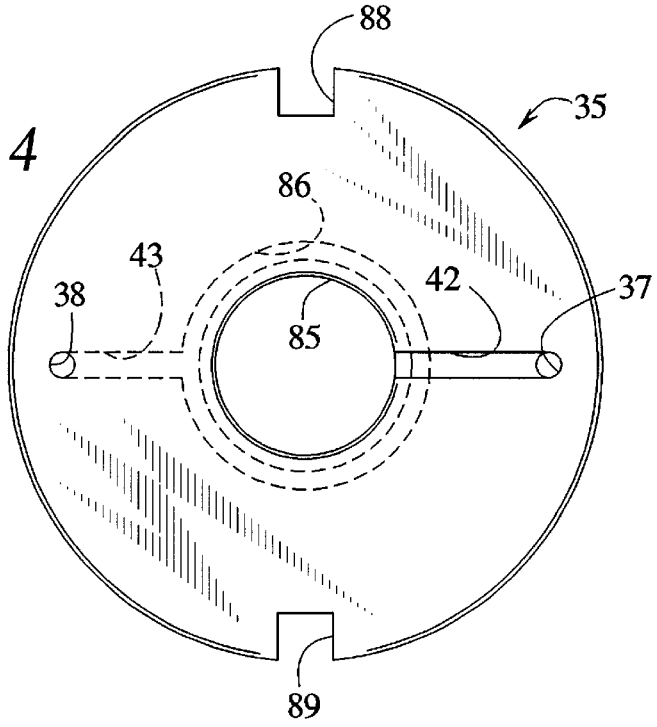
FIG. 4 is a top plan view of a side plate incorporated into the vane pump of the present invention.
Figure 5:
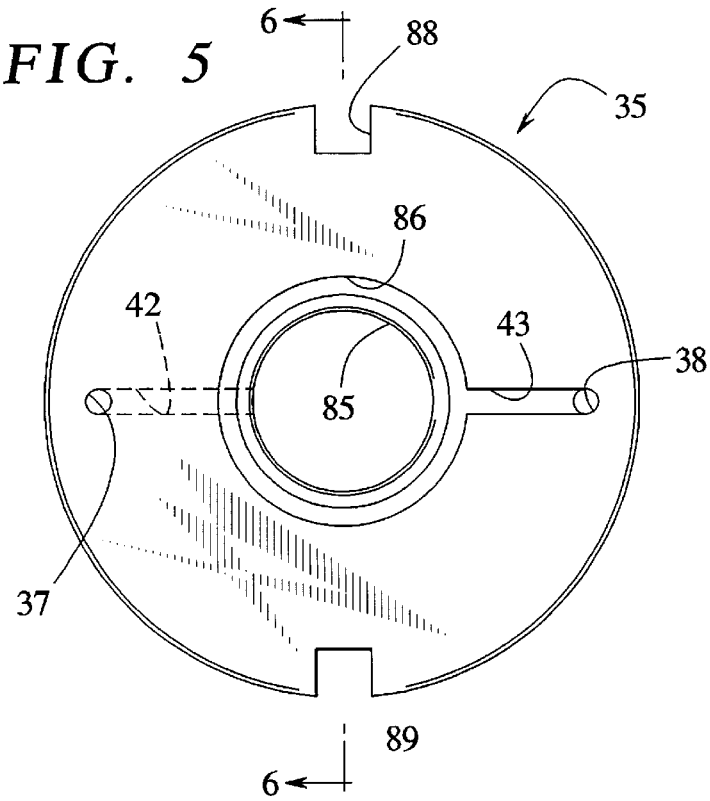
FIG. 5 is a bottom plan view of the side plate shown in FIG. 4.
Figure 6:
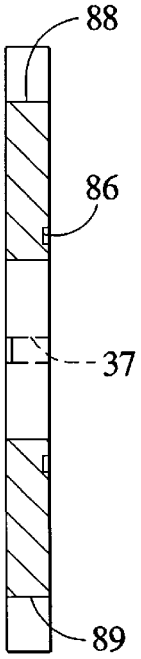
FIG. 6 is a sectional view taken substantially along line 6—6 of FIG. 5.

The rotor 18 is disposed between a first side plate 35 and a second side plate 36. Each side plate preferably includes a pair of through holes, shown at 37–40. Further, each through hole 37–40 is preferably connected to the inner end of the side plate by a radial groove 42–45 respectively. The grooves 42–45, which are illustrated in greater detail in FIGS. 4–6, provide communication to and from the first rotor bearing 29 disposed in the seal head 16 and the second rotor bearing 42.

Similar to the seal head 16, the access head 21 also includes a first access head passageway 48 and a second access head passageway 49, each of which are equipped with threads 45, 46 for selectively plugging the passageways 48, 49 as discussed in detail below.

Specifically, with the side plates 35, 36 arranged in the configuration illustrated in FIG. 1A and further with the seal head passageway 32 plugged at the threads 34 and the access head passageway 49 plugged at the threads 46, fluid enters the pump 10 through the inlet 51 and exits through the outlet 52. Of course, the flow can be reversed, as discussed below so that fluid enters through the port 52 and exits through the port 51. As the rotor shaft 17 rotates in the direction of the arrow 53 (i.e. clockwise when viewed from the motor end; counterclockwise when viewed from the access head 21 end), fluid is forced through the hole 38 disposed in the first side plate 35 and down through the seal head passageway 31 to the seal assembly 28 and rotor bearing 29. The fluid is then transmitted through the gap shown at 55 in the rotor bearing 29 to the space 54 disposed between the first side plate 35 and the rotor shaft 17. The fluid is then communicated radially outward through the groove 42 to the second through hole 37 of the first side plate 35 to the inlet area of the case 14. Fluid is not transmitted down through the seal head passageway 32 because of a plug (not shown) disposed at the threads 34. Thus, during operation of the pump as illustrated in FIG. 1, the first rotor bearing 29 is lubricated by the fluid being pumped.

Similarly, as the rotor shaft 17 rotates in the direction of the arrow 53, fluid is forced through the through hole 39 in the second side plate 36 and down into the access head passageway 48. The access head passageway 48 provides fluid communication between the through hole 39 and the second rotor shaft bearing 42. Fluid then proceeds through the gap shown at 56 to the space shown at 57 between the second seal plate 36 and the distal end 19 of the rotor shaft 17. The fluid is then communicated radially outward through the groove 45 in the second side plate 36 before being engaged by the vane 58. Fluid is not transmitted through the second access head passageway 49 because of a plug (not shown) disposed at the threads 46.

Thus, in FIG. 1A, with the rotor shaft 17 rotating in the direction of the arrow 53, both the first rotor bearing 29 and second rotor bearing 42 are lubricated by the fluid being pumped.

Figure 1B:
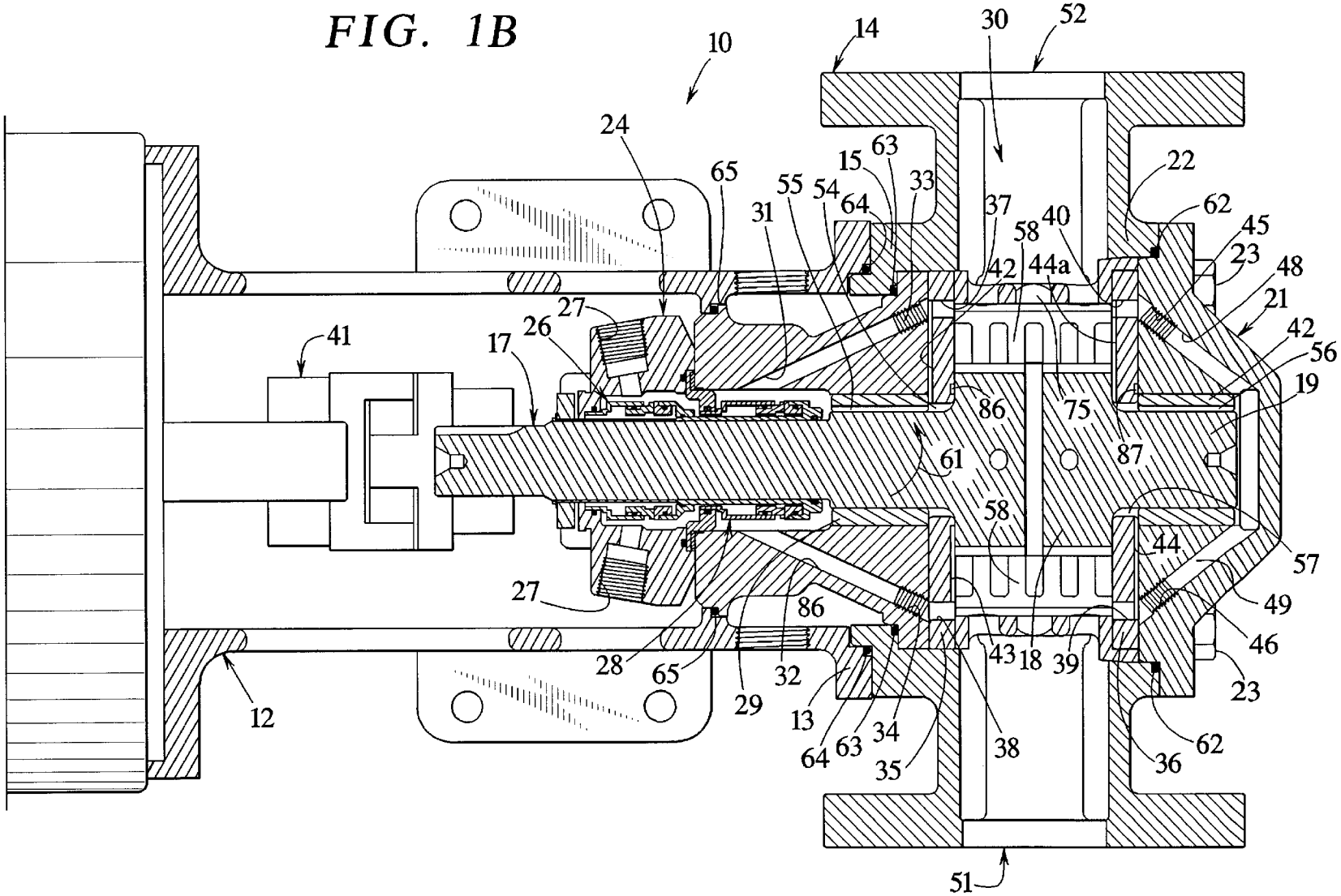
FIG. 1B is a sectional view of the vane pimp first shown in FIG. 1A but with the side plates indexed for reverse flow.

Turning to FIG. 1B, the flow of the pump has been reversed from the port 51 as the inlet to the port 52 as the outlet to using the port 52 as the inlet and the port 51 as the outlet. The rotation of the rotor shaft 17 has been reversed to the direction shown by the arrow 61. To reverse the flow, the access head 21 and the second side plate 36 are removed as is the rotor shaft 17. The vanes, all of which are shown at 58, are rotated 180° within their respective slots (compare FIGS. 1A and 1B). After the rotor shaft 17 has been removed, the first side plate 35 is also removed. The plug disposed at the threads 34 in the second seal head passageway 32 is removed and screwed into the threads 33 disposed in the first seal head passageway 31. Then, the first side plate 35 is replaced, but indexed or rotated 180° so that the first through hole 37 is disposed in alignment with the now-plugged first seal head passageway 31 and the second through hole 38 is disposed in alignment with the now-open second seal head passageway 32. The rotor shaft with the rotated vanes 58 is also replaced. Then, the second side plate 36 is mounted onto the end 19 of the rotor shaft 17, but the second side plate 36 is rotated or indexed 180°. Prior to the re-installation of the access head 21, the plug is removed from the threads 46 in the second access head passageway 49 and screwed into the threads 45 disposed in the first access head passageway 48. Accordingly, when the access head 21 is replaced, the through hole 39 is now disposed in front of the now-open second access head passageway 49 which provides communication between the through hole 39 and the second rotor bearing 42. The through hole 40 is still unused because it is disposed in front of the now-plugged first access head passageway 48.

Accordingly, in the configuration shown in FIG. 1B, with the rotor 18 rotating in the direction of the arrow 61, fluid is forced by the vanes 58 through the second through hole 38 and down through the second seal head passageway 32 so it can lubricate the first rotor bearing 29. Fluid is then communicated by way of the gap 55 to the space 54 before it proceeds radially outward through the groove 42 to the first through hole 37 in the first side plate 35 where it exits to the inlet portion of the case 14. Similarly, on the outboard side of the rotor 18, fluid is forced by the vanes 58 through the through hole 39 in the second plate 36 and down the now-open second seal head passageway 49 to the second rotor bearing 42. The fluid proceeds by way of the slot 56 to the space 57 before proceeding radially outward through the groove 45 to the inlet area of the case 14.

Thus, both rotor bearings 29 and 42 are lubricated by the fluid being pumped as the rotor 18 rotates in the direction of the arrow 61. Similarly, the steps required to reverse the direction of fluid flow from the direction shown in FIG. 1A to the direction shown in FIG. 1B can be performed quickly and easily and without disconnecting any companion piping attached to the ports 51, 52, with disconnecting or removing the prime mover 41 or wiring connecting the pump 10 to a power supply (not shown).

Similarly, FIGS. 1A and 1B illustrate how easy it is to service the rotor bearings 29, 42. Specifically, the access head 21, second side plate 36, rotor shaft 17 and rotor 18 and first side plate 35 can be removed without disturbing any companion piping attached to the ports 51, 52. The seal head is also easily removed for replacement or servicing of the rotor bearing 29. The rotor bearing 42 is also easily removed for service or replacement. Further, the O-rings shown at 62–65 all can be replaced quickly and easily while the direction of flow of the pump 10 is being reversed. Still further, by removing the seal head 16, again, without disturbing pipe connections to the ports 51, 52, the seal assembly 28 may be serviced or replaced.

Turning to FIG. 2, a seal head key 71 is illustrated which is attached to a flange 72 of the seal head 16. The key 71 engages a slot 73 disposed in the tapered cam 75. In a preferred embodiment, the case 14 includes an indexing slot 80 that positions the seal head 16 and cam 75 (see FIGS. 1A and 1B). Disposed between the seal head 16, the case 14 and the mounting bracket 12 is a fluid passageway 76 through which cooling fluid may be circulated through one or more ports like those shown at 77. The plug 78 and passageway 79 in the access head 21 enable the pump 10 to be easily drained prior to servicing or reversing the flow of the pump 10. A relief valve cover shown at 82 is mounted onto the case 14 with the bolts shown at 83.

Figure 3:
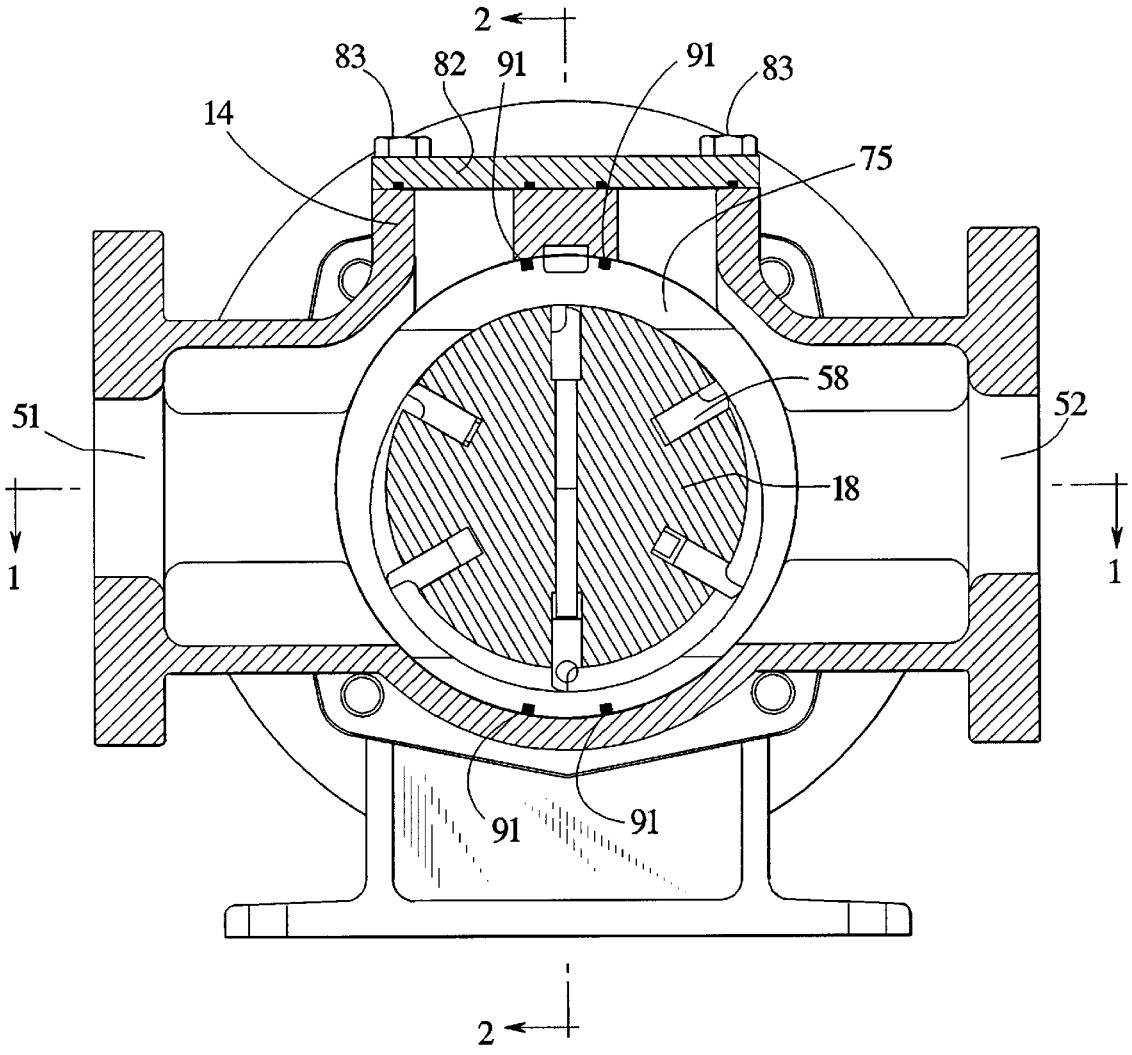
FIG. 3 is an end sectional view of the vane pump shown in FIGS. 1A, 1B and 2.

As illustrated in FIG. 3, the vanes 58 disposed in the rotor 18 may be rotated easily with a simple twisting action. Again, the design of the cam 75, vanes 58 and openings in the cam 75 to the inlet and outlet ports 51, 52 are illustrated in detail in U.S. Pat. No. 5,431,552.

The side plates 35, 36 are illustrated in FIGS. 4–6 by way of the illustration of the first side plate 35. It will be noted that the first and second side plates 35, 36 are intentionally designed so that they are interchangeable. Thus, even though only one through hole 39 is utilized in the second side plate 36 (see FIGS. 1A and 1B), the second side plate 36 is provided with two through holes 39, 40 thereby making the second side plate 36 interchangeable with the first side plate 35. Referring to FIG. 4, the through hole 37 is connected to the central aperture 85 by way of the groove 42. The second through hole 38 is connected to a groove 43 which, in turn, is connected to an annular groove 86. The annular groove 86 is directed towards the rotor 18 as illustrated in FIGS. 1A and 1B. The annular groove 86 enables the fluid being pumped to act as a cooling media and lubrication fluid between the rotor 18 and the side plate 35. A similar annular groove section 87 is disposed in the second side plate 36 and is illustrated in FIGS. 1A and 1B. Thus, while not providing fluid communication to the rotor bearings 29, 42, the radial grooves 43, 44 and annular grooves 86, 87 to provide lubrication and cooling benefits and reduce the wear on the side plates 35, 36. Returning to FIGS. 4–6, the side plate 35 also includes upper and lower slots 88, 89 which are used for indexing purposes.

The components such as the case 14, cam 75 and side plates 35, 36 and rotor 18 which come into contact with the fluid being pumped are preferably made from highly corrosion resistant alloys, such as type 300 series stainless steels. As shown in FIG. 3, the rotor 18 can be equipped with multiple vanes. The conical taper contact by the cam 75 to the case 14 as shown in FIG. 2 avoids the long length of surface contact at assembly or disassembly normally found with replaceable cams. Accordingly, during the operations of reversing the flow or servicing of the bearings and seals, the cam is removed easily. Leakage between the ports 51 and 52 is controlled by the cam seals shown at 91 in FIG. 3.

From the above description, it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed:

1. A pump comprising:

a housing comprising a case comprising a first open end connected to a mounting bracket and a second open end connected to an access head with a pump chamber disposed therebetween, the mounting bracket accommodating a seal head that extends through the mounting bracket and through the first open end of the case, the seal head accommodating a rotor shaft that passes through the seal head, the pump chamber and into the access head, the rotor shaft being connected to a rotor disposed inside the pump chamber between first and second opposing side plates, the first side plate being disposed between the rotor and the seal head, the second side plate being disposed between the rotor and the access head, the rotor shaft being supported by a first bearing disposed outside of the pump chamber and between the seal head and the rotor shaft and adjacent to the first side plate, the rotor shaft also being supported by a second bearing disposed outside of the pump chamber and between the access head and the rotor shaft and adjacent to the second side plate, the first side plate, in combination with the seal head, providing fluid communication between the pump chamber and the first rotor bearing, and the second side plate, in combination with the access head, providing fluid communication between the pump chamber and the second rotor bearing.

2. The pump of claim 1 wherein the first side plate further comprises a central aperture for accommodating the rotor shaft and first and second through holes disposed on opposing sides of the central aperture that provide fluid communication through the first side plate, the first through hole being connected to a first groove that extends radially inward from the first through hole towards the first bearing, the first groove providing fluid communication between the first bearing and the first through hole, the first through hole providing fluid communication between the first bearing and the pump chamber, the second through hole being in alignment with a first seal head passageway, the first seal head passageway extending through the seal head to the rotor shaft and providing communication between the second through hole and the first bearing, the second through hole providing communication between the pump chamber and the first seal head passageway, the second side plate comprising a central aperture for accommodating the rotor shaft and a third through hole that provides fluid communication through the second side plate, the third through hole being in alignment with a first access head passageway, the third through hole providing communication between the pump chamber and the first access head passageway, the first access head passageway extending through the access head to the rotor shaft and providing communication between the third through hole and the second bearing, the second plate further comprising a second groove, the second groove providing communication between the second bearing and the pump chamber.

3. The pump of claim 2 wherein the seal head further comprises a second seal head passageway disposed on an opposing side of the rotor shaft from the first seal head passageway, the second seal head passageway extending through the seal head to the rotor shaft, the second seal head passageway being selectively plugged when the second through hole of the first side plate is in communication with the first seal head passageway.

4. The pump of claim 2 wherein the access head further comprises a second access head passageway disposed on an opposing side of the rotor shaft from the first access head passageway, the second access head passageway extending through the access head to the rotor shaft, the second access head passageway being selectively plugged when the third through hole is in communication with the first access head passageway.

5. The pump of claim 1 wherein the first and second side plates are interchangeable.

6. The pump of claim 2 wherein the second side plate comprises a fourth through hole disposed on an opposing side of the rotor shaft from the third through hole, the first and second side plates are identical in configuration with the second groove of the second side plate being in alignment with the first groove of the first side plate, the first and second through holes of the first side plate being in alignment with the third and fourth through holes of the second side plate.

7. The pump of claim 2 wherein the first side plate includes an annular groove extending around the central aperture of the first side plate and a radial groove providing fluid communication between the annular groove of the first side plate and the pump chamber, the annular groove of the first side plate facing the rotor and accommodating fluid for providing lubrication and cooling between the first side plate and the rotor.

8. The pump of claim 2 wherein the second side plate includes an annular groove that extends around the central aperture of the second side plate and a radial groove that provides fluid communication between the annular groove of the second side plate and the pump chamber.

9. The pump of claim 1 wherein the case further comprises an indexing slot and the seal head comprises a flange, the flange of the seal head being accommodated in the indexing slot of the case.

10. The pump of claim 9 wherein the flange of the seal head further comprises a key, the first side plate further comprising a slot, the key being accommodated in the slot when the first through hole is in alignment with the first seal head passageway.

11. The pump of claim 9 wherein the flange of the seal head further comprises a key, the first side plate further comprising a slot for accommodating the key, the case further comprises a liner, the liner comprising a slot for accommodating the key, the key being accommodated in the slot of the first side plate and the slot of the liner when the first through hole is in alignment with the first seal head passageway.

12. The pump of claim 1 further comprising an internal passageway disposed between the mounting bracket and the seal head, the internal passageway being in communication with an external cooling fluid inlet and an external cooling fluid outlet, the internal passageway for the flow of cooling fluid to cool the seal head.

13. The pump of claim 1 wherein the case further comprises an inlet and an outlet, the inlet is connected to an inlet conduit, the outlet is connected to an outlet conduit, the access head, second bearing, second side plate, rotor shaft, rotor, first side plate and first bearing all being removable through the case without disconnecting the inlet conduit from the inlet or the outlet conduit from the outlet.

14. A pump comprising:

a housing comprising a case comprising a first open end connected to a mounting bracket and a second open end connected to an access head with a pump chamber disposed therebetween, the mounting bracket accommodating a seal head that extends through the mounting bracket and through the first open end of the case, the seal head accommodating a rotor shaft that passes through the seal head, the pump chamber and into the access head, the rotor shaft being connected to a rotor disposed inside the pump chamber between first and second opposing side plates, the first side plate being disposed between the rotor and the seal head, the second side plate being disposed between the rotor and the access head, the rotor shaft being supported by a first bearing disposed outside of the pump chamber and between the seal head and the rotor shaft and adjacent to the first side plate, the rotor shaft also being supported by a second bearing disposed outside of the pump chamber and between the access head and the rotor shaft and adjacent to the second side plate, the seal head comprising first and second seal head passageways disposed on opposing sides of the rotor shaft, the first and second seal head passageways extending through the seal head to the first bearing, the first and second seal head passageways being capable of accommodating a plug to block fluid communication therethrough, the access head comprising first and second access head passageways disposed on opposing sides of the rotor shaft, the first and second access head passageways extending through the access head to the second bearing, the first and second access head passageways being capable of accommodating a plug to block fluid communication therethrough, the first side plate providing fluid communication between the pump chamber and one of said first and second seal head passageways thereby providing fluid communication to the first bearing, and the first side plate providing fluid communication from the first bearing to the pump chamber, the second side plate providing fluid communication between the pump chamber and one of said first and second access head passageways thereby providing fluid communication to the second bearing, and the second side plate also providing fluid communication from the second bearing to the pump chamber.

15. The pump of claim 1 wherein the first side plate can be rotated to selectively provide communication between the chamber and the second seal head passageway, and the second side plate can be rotated to selectively provide communication between the chamber and the second access head passageway.

16. The pump of claim 1 wherein when the pump is pumping in a first direction, the first seal head passageway is unplugged and provides fluid communication between the first side plate and the first bearing and the second seal head passageway is plugged, the first access head passageway is unplugged and provides fluid communication between the second side plate and the second bearing and the second access head passageway is plugged, and when the pump is pumping in a second opposite direction, the second seal head passageway is unplugged and provides fluid communication between the first side plate and the first bearing and the first seal head passageway is plugged, the second access head passageway is unplugged and provides fluid communication between the second side plate and the second bearing and the first access head passageway is plugged.

17. The pump of claim 1 wherein the first side plate further comprises a central aperture for accommodating the rotor shaft and first and second through holes disposed on opposing sides of the central aperture that provide fluid communication through the first side plate, the first through hole being connected to a first groove that extends radially inward from the first through hole towards the first bearing, the first groove providing fluid communication between the first bearing and the first through hole, the first through hole providing fluid communication between the first bearing and the case, the second through hole being in alignment with a first seal head passageway, the first seal head passageway extending through the seal head to the rotor shaft and providing communication between the second through hole and the first bearing, the second through hole providing communication between the case and the first seal head passageway, the second side plate comprising a central aperture for accommodating the rotor shaft and a third through hole that provides fluid communication through the second side plate, the third through hole being in alignment with a first access head passageway, the third through hole providing communication between the pump chamber and the first access head passageway, the first access head passageway extending through the access head to the rotor shaft and providing communication between the third through hole and the second bearing, the second plate further comprising a second groove, the second groove providing communication between the second bearing and the pump chamber.

18. The pump of claim 17 wherein the first and second side plates are interchangeable.

19. The pump of claim 17 wherein the second side plate comprises a fourth through hole disposed on an opposing side of the rotor shaft from the third through hole, the first and second side plates are identical in configuration with the second groove of the second side plate being in alignment with the first groove of the first side plate, the first and second through holes of the first side plate being in alignment with the third and fourth through holes of the second side plate.

20. The pump of claim 17 wherein the first side plate includes an annular groove extending around the central aperture of the first side plate and a radial groove providing fluid communication between the annular groove of the first side plate and the pump chamber, the annular groove of the first side plate facing the rotor and accommodating fluid for providing lubrication and cooling between the first side plate and the rotor.

21. The pump of claim 17 wherein the second side plate includes an annular groove that extends around the central aperture of the second side plate and a radial groove that provides fluid communication between the annular groove of the second side plate and the pump chamber.

22. A reversible vane pump comprising:

a housing comprising a case comprising a first open end connected to a mounting bracket and a second open end connected to an access head with a pump chamber disposed therebetween, the mounting bracket accommodating a seal head that extends through the mounting bracket and through the first open end of the case, the seal head accommodating a rotor shaft that passes through the seal head, the case and into the access head, the rotor shaft being connected to a rotor disposed inside the pump chamber between first and second opposing side plates, the first side plate being disposed between the rotor and the seal head, the second side plate being disposed between the rotor and the access head, the rotor shaft being supported by a first bearing disposed outside of the pump chamber and between the seal head and the rotor shaft and a second bearing disposed outside of the pump chamber between the access head and the rotor shaft, the first side plate comprising a central aperture for accommodating the rotor shaft and first and second through holes disposed on opposing sides of the central aperture that provide fluid communication through the first side plate, the first through hole being connected to a first groove which extends radially inward towards the first bearing, the first groove providing communication between the first bearing and the first through hole, the second through hole being connected to a second groove which extends radially inward towards the first bearing, the second groove providing communication between the annular groove and the second through hole, the seal head comprising first and second seal head passageways disposed on opposing sides of the rotor shaft, the first and second seal head passageways extending through the seal head to the first bearing, the first and second seal head passageways being capable of accommodating a plug to block fluid communication therethrough, the second side plate comprising a central aperture for accommodating the rotor shaft and third through hole for providing fluid communication through the second side plate, the second plate further comprising a third groove for providing communication between the second bearing and the pump chamber, the access head comprising first and second access head passageways disposed on opposing sides of the rotor shaft, the first and second access head passageways extending through the access head to the second bearing, the first and second access head passageways being capable of accommodating a plug to block fluid communication therethrough, when the pump is pumping fluid in a first direction, the first through hole is aligned with the first seal head passageway and the second through hole is aligned with the second seal head passageway and the first seal head passageway is plugged, the first groove providing communication between the first bearing and the first through hole, the first through hole providing communication between the first bearing and the pump chamber, the second seal head passageway providing communication between the second through hole and the first bearing, the second through hole providing communication between the pump chamber and the second seal head passageway, and the third through hole is in alignment with the first access head passageway and the second access head passageway is plugged, the third through hole providing communication between the pump chamber and the first access head passageway, the first access head passageway providing communication between the third through hole and the second bearing, the third groove providing communication between the second bearing and the pump chamber, when the pump is pumping in a second direction, the first through hole is aligned with the second seal head passageway and the second through hole is aligned with the first seal head passageway and the second seal head passageway is plugged, the first groove providing communication between the first bearing and the first through hole, the first through hole providing communication between the first bearing and the pump chamber, the first seal head passageway providing communication between the second through hole and the first bearing, the second through hole providing communication between the pump chamber and the first seal head passageway, and the third through hole is in alignment with the second access head passageway and the first access head passageway is plugged, the third through hole providing communication between the pump chamber and the second access head passageway, the second access head passageway providing communication between the third through hole and the second bearing, the third groove providing communication between the second bearing and the pump chamber.

23. The pump of claim 22 wherein the first and second side plates are interchangeable.

24. The pump of claim 22 wherein the second side plate comprises a fourth through hole disposed on an opposing side of the rotor shaft from the third through hole, the first and second side plates are identical in configuration with the second groove of the second side plate being in alignment with the first groove of the first side plate, the first and second through holes of the first side plate being in alignment with the third and fourth through holes of the second side plate.

25. The pump of claim 22 wherein the case further comprises an inlet and an outlet, the inlet is connected to an inlet conduit, the outlet is connected to an outlet conduit, the access head, second bearing, second side plate, rotor shaft, rotor, first side plate and first bearing all being removable through the case without disconnecting the inlet conduit from the inlet or the outlet conduit from the outlet.

26. A method of reversing the flow of a vane pump, the method comprising the following steps:

providing a vane pump comprising a housing comprising a case comprising a first open end connected to a mounting bracket and a second open end connected to an access head with a pump chamber disposed therebetween, the case comprising in a first case port and a second case port with first and second conduits being connected to the first and second case ports respectively, the mounting bracket accommodating a seal head that extends through the mounting bracket and through the first open end of the case, the seal head accommodating a rotor shaft that passes through the seal head, the case and into the access head, the rotor shaft being connected to a rotor disposed inside the pump chamber between first and second opposing side plates, the rotor comprising a plurality of sliding vanes, the first side plate being trapped between the rotor and the seal head, the second side plate being trapped between the rotor and the access head, the rotor shaft being supported by a first bearing disposed outside the pump chamber and between the seal head and the rotor shaft and a second bearing disposed outside the pump chamber and between the access head and the rotor shaft, the first side plate comprising a central aperture for accommodating the rotor shaft and first and second through holes disposed on opposing sides of the central aperture that provide fluid communication through the first side plate, the first through hole being connected to a first groove which extends radially inward towards the first bearing, the first groove providing communication between the first bearing and the first through hole, the second through hole being connected to a second groove which extends radially inward towards the first bearing, the second groove providing communication between the second bearing and the second through hole, the seal head comprising first and second seal head passageways disposed on opposing sides of the rotor shaft, the second side plate comprising a central aperture for accommodating the rotor shaft and third through hole for providing fluid communication through the second side plate, the second plate further comprising a third groove for providing communication between the second bearing and the case, the access head comprising first and second access head passageways disposed on opposing sides of the rotor shaft, when the pump is pumping fluid in a first direction from the first case port to the second case port, the first through hole is aligned with the first seal head passageway and the second through hole is aligned with the second seal head passageway and the first seal head passageway is plugged, the first groove providing communication between the first bearing and the first through hole, the first through hole providing communication between the first bearing and the pump chamber, the second seal head passageway providing communication between the second through hole and the first bearing, the second through hole providing communication between the pump chamber and the second seal head passageway, and the third through hole is in alignment with the first access head passageway and the second access head passageway is plugged, the third through hole providing communication between the pump chamber and the first access head passageway, the first access head passageway providing communication between the third through hole and the second bearing, the third groove providing communication between the second bearing and the pump chamber;

removing the access head, second side plate, rotor shaft, and rotor without disconnecting the first and second conduits from the first and second case ports;

removing the plug from the second seal head passageway;

inserting a plug into the first seal head passageway;

rotating the first side plate 180° so that the first through hole is alignment with the second case head passageway;

rotating the vanes in the rotor 180°;

replacing the rotor shaft and rotor;

rotating the second side plate 180° and replacing the second side plate;

removing the plug from the second access head passageway;

inserting a plug into the first access head passageway;

replacing the access head so that the third through hole is in alignment with the second access head passageway;

reversing the rotation of the rotor and rotor shaft.

* * * * *